US006008712A

United States Patent [19]

Tokuda et al.

[11] Patent Number: 6,008,712

[45] Date of Patent: Dec. 28, 1999

[54] SMALL SIZED TRANSFORMER WITH COVER

[75] Inventors: Yosihiro Tokuda; Yuji Haga, both of Skado, Japan

[73] Assignee: Tamura Corporation, Tokyo, Japan

[21] Appl. No.: 09/292,755

[22] Filed: Apr. 14, 1999

[30] Foreign Application Priority Data

Apr. 14, 1998 [JP] Japan ..... 10-102694

[51] Int. Cl.[6] ..... H01F 27/29; H01F 27/30

[52] U.S. Cl. ..... 336/198; 336/192; 336/208

[58] Field of Search ..... 336/198, 192, 336/208

[56] References Cited

U.S. PATENT DOCUMENTS

| | | | |
|---|---|---|---|
| 3,909,761 | 9/1975 | Miles | 336/192 |
| 4,405,913 | 9/1983 | Finkbeiner | 336/98 |
| 4,510,478 | 4/1985 | Finkbeiner | 336/198 |
| 4,716,394 | 12/1987 | Gordon | 336/192 |
| 5,157,368 | 10/1992 | Okano et al. | 336/90 |
| 5,502,429 | 3/1996 | Jong et al. | 336/192 |
| 5,548,264 | 8/1996 | Teshima et al. | 336/65 |
| 5,815,061 | 9/1998 | Ho | 336/192 |

FOREIGN PATENT DOCUMENTS

| | | |
|---|---|---|
| 06302438 | 10/1994 | Japan . |
| 08227818 | 9/1996 | Japan . |
| 09045550 | 2/1997 | Japan . |
| 09306760 | 11/1997 | Japan . |

*Primary Examiner*—Michael L. Gellner
*Assistant Examiner*—Anh Mai
*Attorney, Agent, or Firm*—Mason & Assoc., P.A.; Dennis G. LaPointe; Joseph C. Mason, Jr.

[57] ABSTRACT

A transformer with a modified cover and terminal portion of the coil bobbin to increase the creepage path between a terminal and a core, thus enhancing insulation performance. The invention discloses a cover on a coil bobbin, and includes a groove for increasing a creepage path which is formed in the high voltage side of a coil bobbin terminal portion with an embedded terminal. A projecting insulation wall which is inserted into the groove is formed inside the cover. A bent portion of the terminal is positioned on a lower side of the insulation wall. The transformer core is positioned on the upper side of the projecting insulation wall so as to improve the insulation performance and to allow for reducing or miniaturizing the height between the core and the bent portion of the terminal.

1 Claim, 1 Drawing Sheet

SMALL SIZED TRANSFORMER WITH COVER

BACKGROUND OF THE INVENTION

1. Field of the Invention

The present invention relates to transformers used in commercial electronic devices, for example, audio amplifiers and more specifically to a pin terminal type typically found in smaller transformers used in such commercial devices. The invention relates in particular to the enhancement of insulation performance between a core and a pin terminal by providing a modification which increases the creepage path between the core and the pin terminal.

2. Description of Related Art

Conventional transformers with pin terminals used in commercial electronic devices are generally manufactured with a coil bobbin which has a terminal portion in which an L-shaped pin terminal is embedded. The transformer assembly further includes a cover which generally covers the coil bobbin and a core. The cover is made of an insulative resin material. When the cover is assembled to the terminal portion of the bobbin, a portion of the cover forms a partition wall-like ceiling plate above the L-shaped pin terminal. The ceiling plate forms an insulation wall between the core positioned above the ceiling plate and the bent portion of the L-shaped pin terminal located under the ceiling plate.

It is however difficult to miniaturize the transformers while ensuring that the insulation between the core and the pin terminal prevents creepage in such a manner as to ensure adequate insulation resistant performance.

SUMMARY OF THE INVENTION

The present invention achieves the above objectives. The invention includes a modification to a transformer with a coil bobbin, cover and core combination, wherein the coil bobbin has a terminal portion, including a terminal embedded in the terminal portion. The terminal has a substantially L-shaped bent portion and the cover has a portion adapted to cover the terminal portion of the coil bobbin. The modification is a groove for increasing a creepage path which is formed in the terminal portion. The portion of the cover adapted to cover the terminal portion of the coil bobbin has a projecting insulation wall adapted to engage the groove. The projecting insulation wall extends from the cover portion adapted to cover the terminal portion of the coil bobbin. The bent portion of the terminal is thus positioned on a lower side of the projecting insulation wall and the core is positioned on an upper side of the insulation wall. The projecting insulation wall inserted into the groove provides for an extended creepage path thus allowing the miniaturizing of the transformer wherein the height between the core and the pin terminal bent portion can be reduced.

DETAILED DESCRIPTION OF THE INVENTION

Figure 1:
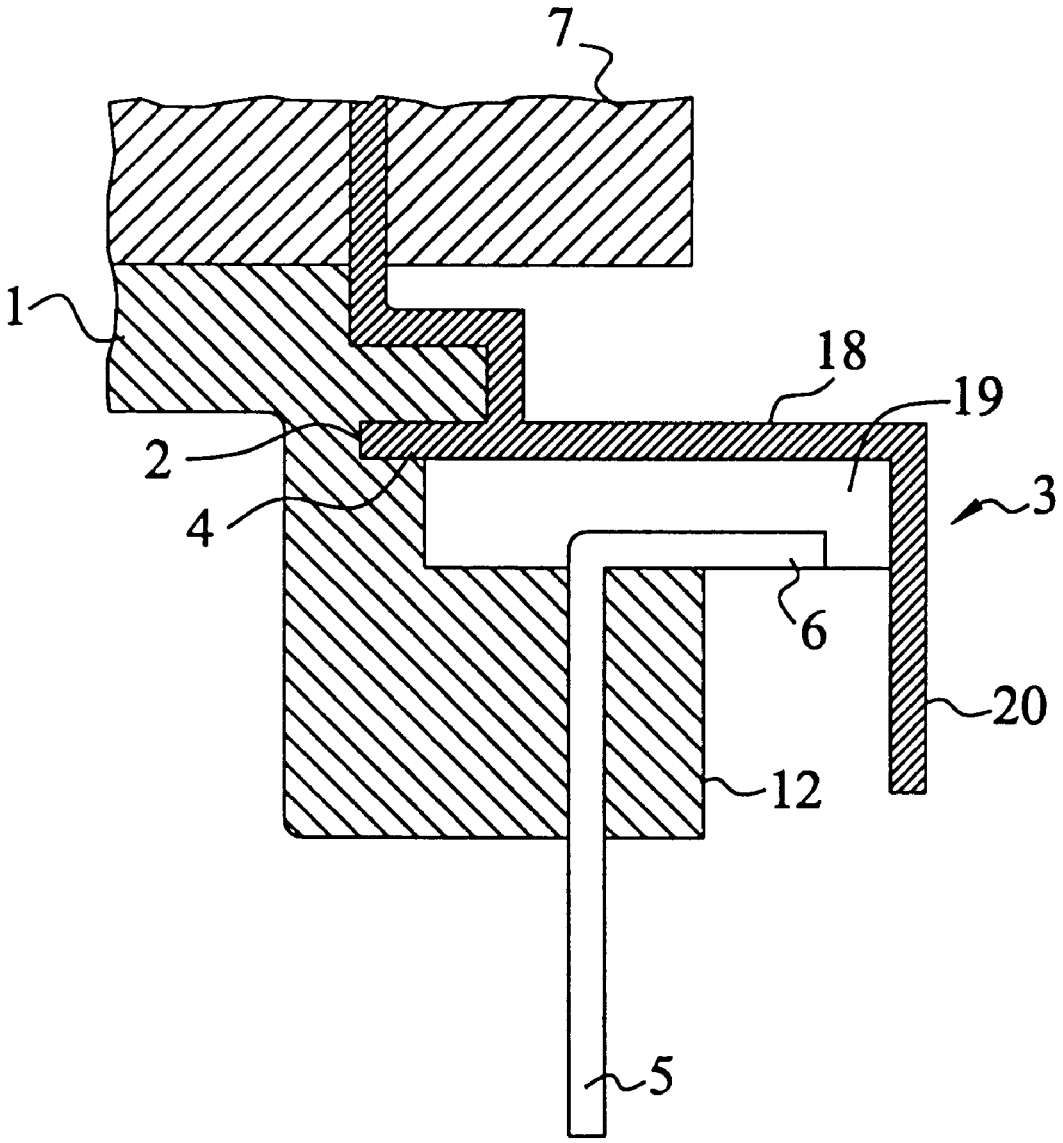
FIG. 1 is a partial cross-sectional view showing the essential features of the present invention.

As shown in FIG. 1, the present invention includes a groove 2 which is formed in a part of the coil bobbin 1. Accordingly, a creepage path of 6 mm, which was hither to less than 6 mm, can be obtained. Further, a partition wall-like insulation wall 4 is projected inside a cover 3. The projecting insulation wall 4 is inserted and disposed in the groove 2 and a resultant insulation performance between a bent portion 6 of the terminal 5 and a core 7 is significantly improved.

A transformer cover 3 generally covers not only the main body (not shown) of the transformer, but also has a substantially box-like terminal bent portion which covers a thick terminal portion 12. The terminal bent portion cover 3 has a shape substantially corresponding to a shape of the terminal portion 12 which has a thickness of the coil bobbin 1 with a terminal 5 embedded therein.

The terminal bent portion cover 3 has, for example, a ceiling plate 18, end plates 19 on both sides and a side plate 20. The ceiling plate 18 has a substantially L-shaped form in a vertically sectional surface covering a step portion 21. The ceiling plate 18 is formed with a cover portion covering a substantially L-shaped terminal bent portion in a vertically sectional surface which extends to the outside in a side surface direction in a lower portion outside the above portion and which covers a terminal bent portion 6. In other words, the substantially L-shaped cover portion in a vertically sectional surface is formed by a step portion of the ceiling plate 18 lowered by one step and the side plate 20.

Further, as shown in FIG. 1, a partition-like projecting insulation wall 4 projects toward a groove 2 formed on a side surface under the step portion 21 of the terminal portion 12 of the coil bobbin 1. A concaved groove 2 is formed on the end surface under the step portion 21 of the terminal portion 12 of the coil bobbin and a top end portion of the projecting insulation wall is inserted into this groove 2. Due to the concave configuration of the groove 2 and the insertion of the insulative resin material, from which the projecting insulation wall 4 is made, in the groove 2, a path along a surface of the coil bobbin 1 between the bent portion 6 of the terminal 5 and the core 7, namely the creepage path, is increased. In other words, it is possible to increase and secure the creepage path.

In addition to acquiring an increase in the distance of the creepage path, since the ceiling plate 18 and the projecting insulation wall 4 are disposed between the bent portion 6 and the core 7, it is thereby possible to enhance the insulation performance between the bent portion 6 and the core 7. The invention is typically provided to the high voltage side of the transformer.

As described above, since the groove 2 with the inserted projecting insulation wall 4 extends the creepage path between the core 7 and the terminal 5 in the terminal portion 12, it is possible to enhance an insulation performance between the core 7 and the terminal 5 while allowing for a reduction in height between the core 7 and the bent portion 6 of the terminal.

Hence a compactness can be achieved by reducing the height between the core 7 and the bent terminal 6. The height can be reduced by about 3 mm. Further, the dimension of the miniaturized transformer utilizing the present invention is, for example, about 36 mm high, about 35 mm wide and about 32 mm long. These dimensions can be accordingly changed to conform to the specification of the transformer.

The invention is clearly new and useful. Moreover, it was not obvious to those of ordinary skill in this art at the time it was made, in view of the prior art considered as a whole as required by law.

It will thus be seen that the objects set forth above, and those made apparent from the foregoing description, are efficiently attained and since certain changes may be made in the above construction without departing from the scope of the invention, it is intended that all matters contained in the foregoing construction or shown in the accompanying drawings shall be interpreted as illustrative and not in the limiting sense.

It is also to be understood that the following claims are intended to cover all of the generic and specific features of the invention herein described, and all statements of the scope of the invention which, as a matter of language, might be said to fall therebetween.

Now that the invention has been described,

DESCRIPTION OF THE REFERENCE NUMERALS

1: coil bobbin
2: groove
3: cover
4: insulation wall
5: terminal
6: bent portion
7: core
8: winding drum portion
9: primary side coil
10: flange
11: intermediate flange
12: terminal portion
13: ceiling plate
14: side plate
15: end plate
16: window
17: window
3*a:* cover main body
3*b:* terminal bent portion cover
18: ceiling plate
19: end terminal
20: side plate
21: step portion

What is claimed is:

1. A transformer with a coil bobbin, cover and core combination, wherein the coil bobbin has a terminal portion, including a terminal embedded in said terminal portion;

the terminal has a substantially L-shaped bent portion;

the cover has a portion adapted to cover the terminal portion of the coil bobbin;

a groove for increasing a creepage path is formed in said terminal portion;

the portion of the cover adapted to cover the terminal portion of the coil bobbin further includes a projecting insulation wall adapted to engage said groove, the projecting insulation wall extending from the cover portion adapted to cover the terminal portion of the coil bobbin;

the bent portion of the terminal is positioned on a lower side of the projecting insulation wall; and the core is positioned on an upper side of the insulation wall.

* * * * *